US010880974B2

(12) United States Patent
Bucci

(10) Patent No.: US 10,880,974 B2
(45) Date of Patent: Dec. 29, 2020

(54) LOW VOLTAGE LIGHTING CONTROL SYSTEM AND METHODS OF CONTROL

(71) Applicant: Pyramid Time Systems, LLC, Meriden, CT (US)

(72) Inventor: George Bucci, Meriden, CT (US)

(73) Assignee: PYRAMID TIME SYSTEMS, LLC, Meriden, CT (US)

( * ) Notice: Subject to any disclaimer, the term of this patent is extended or adjusted under 35 U.S.C. 154(b) by 0 days.

(21) Appl. No.: 16/527,956

(22) Filed: Jul. 31, 2019

(65) Prior Publication Data

US 2020/0163178 A1 May 21, 2020

Related U.S. Application Data

(60) Provisional application No. 62/770,282, filed on Nov. 21, 2018.

(51) Int. Cl.
*H05B 33/00* (2006.01)
*H05B 47/175* (2020.01)
*H05B 45/00* (2020.01)

(52) U.S. Cl.
CPC ..... *H05B 47/175* (2020.01); *H05B 45/00* (2020.01)

(58) Field of Classification Search
CPC ..... H05B 47/19; H05B 45/37; H05B 45/20; H05B 45/10; H05B 47/105; H05B 47/16; H05B 41/2828; H05B 45/00; H05B 47/11; H05B 45/50; H05B 47/185; H05B 2203/036; H05B 3/34; H05B 3/342; H05B 41/2827; H05B 41/3927
See application file for complete search history.

(56) References Cited

U.S. PATENT DOCUMENTS

2017/0223807 A1* 8/2017 Recker ..... H02J 7/34

* cited by examiner

*Primary Examiner* — Monica C King
(74) *Attorney, Agent, or Firm* — DeLio Peterson & Curcio LLC; David R. Pegnataro

(57) ABSTRACT

A wired system and method for controlling lighting attributes of at least one low voltage lighting device. The method comprises selecting desired lighting attributes via an input means at a lighting controller or transmitter, serializing and encoding the selected lighting attributes and at least one device address into a data stream output by the transmitter, propagating the encoded data stream through pulse shaping circuitry to at least one power device which drives an output wire comprising both data and power, decoding the lighting attributes from the encoded data stream by a microcontroller within a receiver connected to the output wire, and applying the decoded lighting attributes to at least one output power device to drive at least one low voltage lighting device. The output wire may be connected to receivers in different lighting zones, each lighting zone including a receiver having a different device address, and responsive to the decoded device address data and the receiver device address matching, the method includes applying the lighting attributes to at least one output power device to drive at least one low voltage lighting device in the lighting zone.

20 Claims, 7 Drawing Sheets

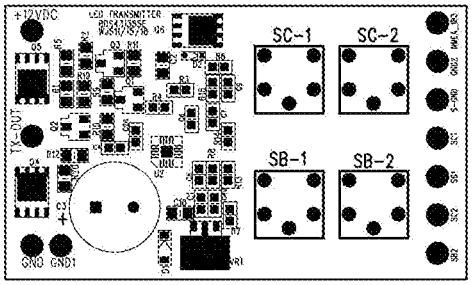
FIG. 6
FIG. 7
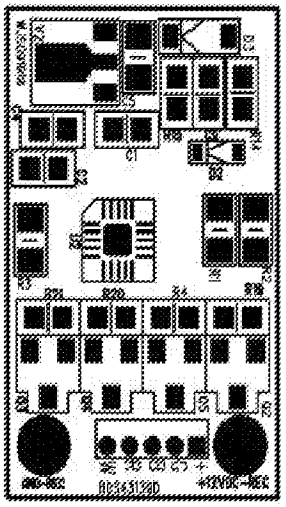

LOW VOLTAGE LIGHTING CONTROL SYSTEM AND METHODS OF CONTROL

BACKGROUND OF THE INVENTION

1. Field of the Invention

The present invention relates to low voltage lighting systems, and more particularly, to a simplified control system and method for adjusting attributes of low voltage lighting, such as LED lighting.

2. Description of Related Art

LED systems for vehicles, such as boats and RVs, are known in the art. Industry trends have been to add multi-colored, dimmable lighting in many areas, such as around cup holders, along steps and walk areas, as accent lighting, and as general and overhead lighting. Ideally, the range of full bright white to colored and dimmed lighting is desired to preserve night vision, such as for nighttime boating.

Current color LED systems comprise a four wire (red, blue, green, and a Return) or five wire (red, blue, green, white, and a Return) system with PWM (pulse width modulation) sent from a controller location to each of the controlled devices, requiring long wire runs. These systems inherently require substantial materials and labor to install, and thus high costs. Moreover, current systems can create unacceptable EMI (electromagnetic interference) and RFI (radio frequency interference) emissions. As described, for example, in U.S. Coast Guard Safety Alert 13-18, issued on Aug. 15, 2018, there is also an LED interference issue which must be obviated with respect to marine use.

Therefore, a need exists for an improved low voltage lighting control system which allows for multicolored, dimmable lighting as desired, with reduced wiring complexity, and which emits EMI and RFI within acceptable ranges.

SUMMARY OF THE INVENTION

Bearing in mind the problems and deficiencies of the prior art, it is therefore an object of the present invention to provide an improved control system for LED lighting or other low voltage lighting types, e.g., incandescent, which reduces materials and labor costs.

It is another object of the present invention to provide a simplified low voltage lighting control system which allows for both white and multicolored dimmable lighting as desired, with reduced wiring complexity.

It is still another object of the present invention to provide an improved low voltage lighting control system which minimizes both EMI and RFI emissions.

It is yet another object of the present invention to provide a low voltage lighting control system which addresses multiple devices, such that more than one zone of lighting can be controlled on one wire run.

It is still yet another object of the present invention to provide an improved method of controlling the attributes of low voltage lighting, including color and brightness.

Still other objects and advantages of the invention will in part be obvious and will in part be apparent from the specification.

The above and other objects, which will be apparent to those skilled in the art, are achieved in the present invention which is directed in an exemplary aspect to a simplified multi-colored, dimmable LED or other low voltage lighting control system comprising a pair of FETs (field-effect transistors) located at a lighting controller and adapted to send a pulse-controlled signal to multiple zones via a plurality of remotely-located receivers along a single long wire run, wherein each receiver is connected to an LED or other low voltage lighting device via a short, multi-wire run. The system comprises, in one embodiment, a transmitter having an input means for selecting lighting attributes such as color and brightness levels, optionally, an NMEA receiver, a TX microcontroller adapted to output an encoded data stream, a pulse shaping network, a plurality of field-effect transistors (FETS), a power output, one or more receivers, a data discriminator, an RX microcontroller, and one or more pulse-controllable LEDs or other low voltage lighting devices.

In another exemplary aspect, the present invention is directed to a method of controlling the attributes of low voltage lighting, such as LEDs, using a pulse-controlled PWM signal sent from a lighting controller to at least one of a plurality of receivers via a single wire run. In an embodiment, the method comprises selecting desired LED or other low voltage lighting attributes such as color and brightness levels via an input means at a lighting controller, serializing and encoding the selected data into a data stream output by a transmitter microcontroller, passing the data stream output to a pulse shaping network, propagating the signal through a power output to one or more remotely-located receivers in one or more lighting zones, decoding the data stream by a receiver microcontroller into device address and color data, comparing the decoded device address data with receiver address data, and responsive to the device address matching, sending the color values to pulse width modulation (PWM) registers within the receiver microcontroller. The method then comprises outputting the PWM by the receiver microcontroller, thus changing the duty cycle of LED driver field-effect transistors (FETS) which drive LEDs or other low voltage lighting, wherein the LEDs' brightness is proportional to the PWM values.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 6 is an exemplary transmitter chip layout of an embodiment of the present invention.

FIG. 7 is an exemplary receiver chip layout of an embodiment of the present invention.

DESCRIPTION OF THE EMBODIMENT(S)

Figure 1:
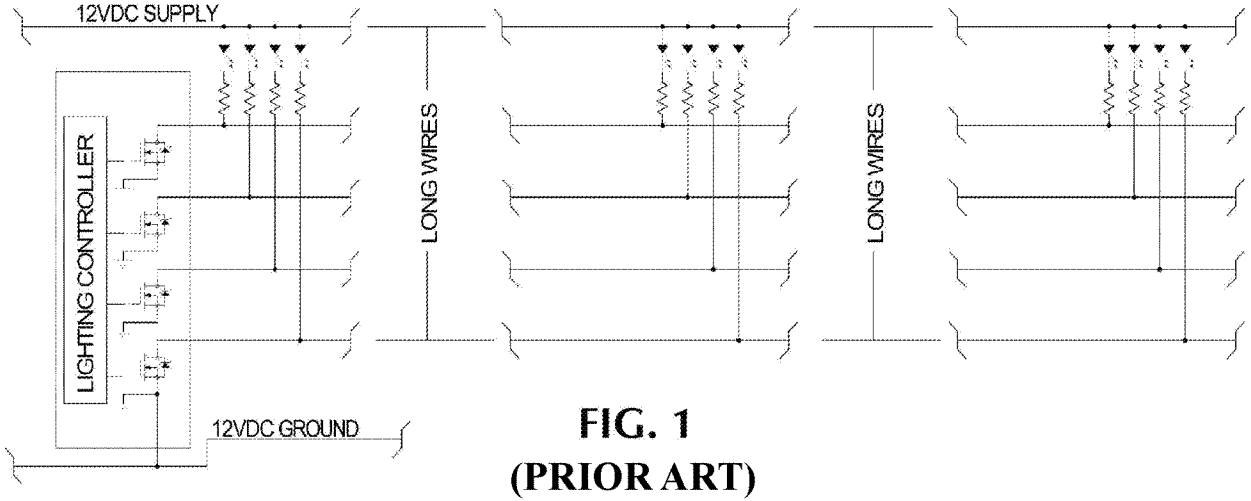
FIG. 1 (PRIOR ART)
FIG. 1 is a schematic diagram of a conventional prior art LED control system.

In describing the embodiments of the present invention, reference will be made herein to FIGS. 2-9 of the drawings in which like numerals refer to like features of the invention.

Certain terminology is used herein for convenience only and is not to be taken as a limitation of the invention. For example, words such as "upper," "lower," "left," "right," "horizontal," "vertical," "upward," "downward," "clockwise," and "counterclockwise" merely describe the configuration shown in the drawings. Indeed, the referenced components may be oriented in any direction and the terminology, therefore, should be understood as encompassing such variations unless specified otherwise. For purposes of clarity, the same reference numbers may be used in the drawings to identify similar elements.

Additionally, in the subject description, the word "exemplary" is used to mean serving as an example, instance or illustration. Any aspect or design described herein as "exemplary" is not necessarily intended to be construed as preferred or advantageous over other aspects or design. Rather, the use of the word "exemplary" is merely intended to present concepts in a concrete fashion.

The present invention is directed to a control system and methods of control for low voltage lighting, wherein data and power is transmitted over a single wire run to control attributes of the lighting, such as color and brightness. Any reference to low voltage lighting herein should be understood to mean 48 VDC and below, and more particularly, in the range of 12 or 24 VDC. In the subject description below, reference to pulse width modulation (PWM) control of LED lighting is used for exemplary purposes only, and it should be understood by those skilled in the art that other methods of lighting control, e.g., analog or on/off, and other low voltage lighting types, such as incandescent lighting or high-intensity discharge (HID) lighting, are intended to fall within the scope of the present invention. As such, although the terms "LED" or "low voltage lighting" are used interchangeably herein, the terms should be understood to refer generally to any now-known or later developed form of lighting at 48 VDC and below.

FIG. 1 depicts a schematic diagram of a conventional prior art multicolor LED control system. As shown in FIG. 1, the LED control system is a five wire (+12 VDC, red, blue, green, white) system comprising a lighting controller connected to a plurality of LEDs positioned remotely from the lighting controller. The lighting controller is connected to each LED via five long wire runs which extend from the controller directly to each LED. In applications such as on boats, this means that the multiple wire runs may extend along the entire length of the hull, for example, in orientations where the lighting controller is positioned on one end and the furthest LEDs are on the opposite end of the boat. Such a system inherently requires substantial materials and labor to install, and thus high costs.

Such systems also often create unacceptable EMI (electromagnetic interference) and RFI (radio frequency interference) emissions. For example, as described in U.S. Coast Guard Safety Alert 13-18, issued on Aug. 15, 2018, an LED interference issue has been reported where mariners have reported poor reception on VHF frequencies used for radiotelephone, digital selective calling (DSC) and automatic identification systems (AIS) when in the vicinity of LED lighting on-board ships. Such radio frequency interference caused by LEDs can create safety hazards.

The present invention remedies these deficiencies of prior art low voltage lighting control systems by providing an improved control system which allows for multicolored, dimmable lighting as desired, with reduced wiring complexity, and negligible EMI and RFI emissions.

Referring now to FIGS. 2-9, an embodiment of a simplified LED or other low voltage lighting control system of the present invention is shown. The LED control system of the present invention may be used, for example, in boating and RV applications such as lighted cup holders, along steps and walk areas, as accent lighting, and as general and overhead lighting. It should be understood by those skilled in the art that the LED system of the present invention is not limited to boating and RV applications, and may also be adapted for use in various other applications where control of LED brightness and color is beneficial, including stationary or non-mobile applications.

Figure 2:
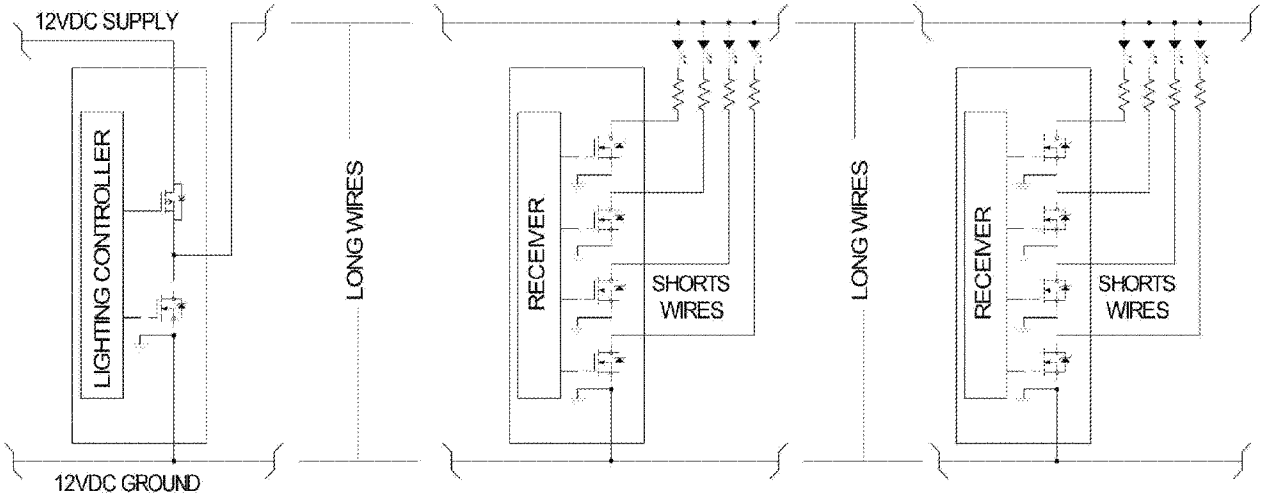
FIG. 2 is an exemplary schematic diagram of one embodiment of the LED or other low voltage lighting control system of the present invention.

The low voltage lighting control system of the present invention presents a solution to the long wire runs required in systems of the prior art. As shown in FIG. 2, in an embodiment, a pair of power devices or electronic switches, such as FETs (field-effect transistors), are located at the lighting controller or transmitter, and are adapted to send a pulse-controlled signal to a plurality of remotely-located receivers along a single long wire run, wherein each receiver is connected to an adjacent LED or other low voltage lighting device via a short, multi-wire run. It should be understood by those skilled in the art that while the exemplary embodiment of the present invention shown in FIG. 2 utilizes FETs, any other now-known or later developed type of power transistor may also be utilized and is not intended to be precluded. An advantage of the present invention is that lower switching current is produced over conventional LED control systems because multiple receivers with inherently lower current drivers are utilized. As will be described in more detail below, the pulse-controlled signal enables the selection of lighting attributes, such as LED color and brightness, on demand.

Figure 3:
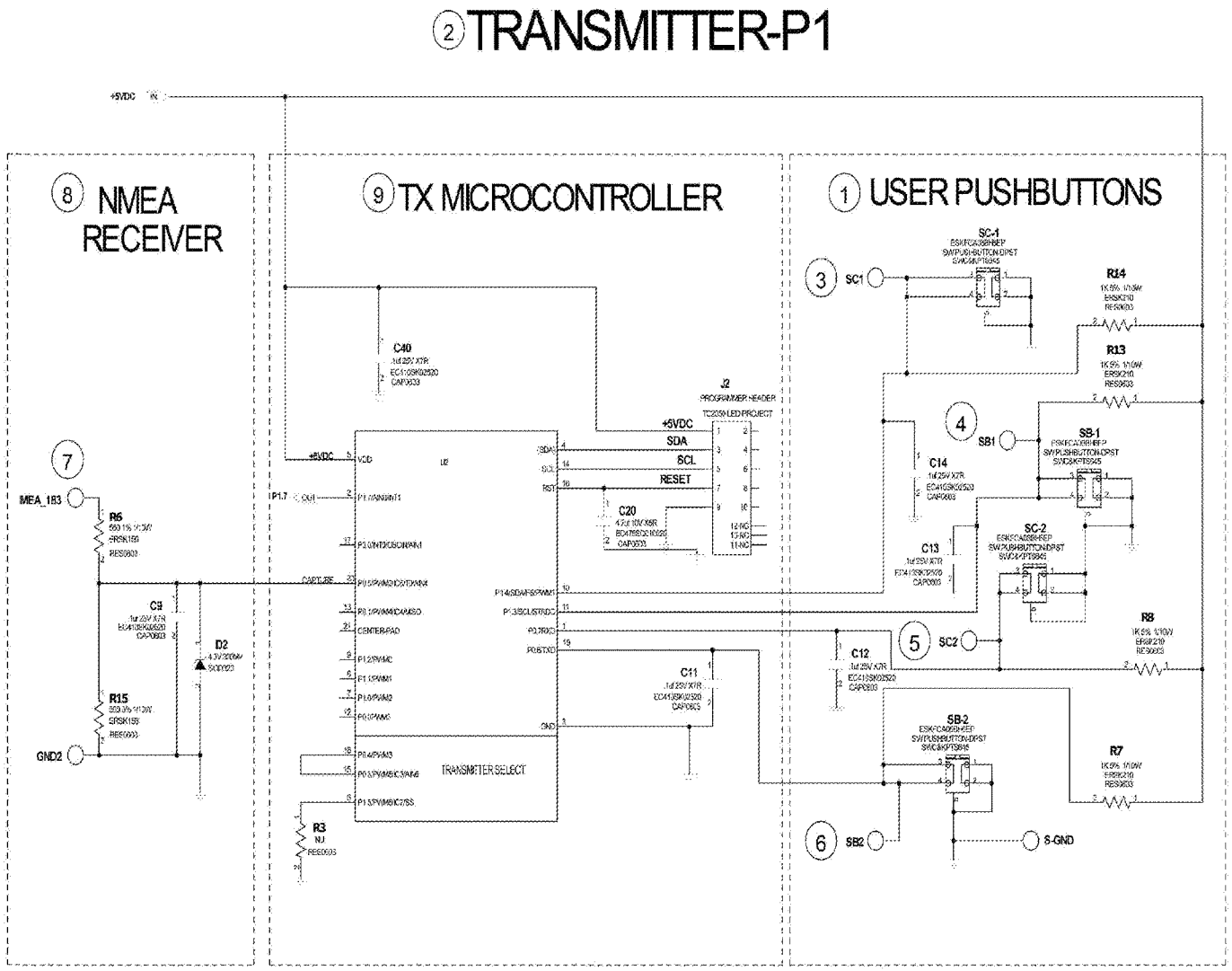
FIGS. 3 and 4 are schematic diagrams depicting the transmitter side of the embodiment of the LED control system of the present invention shown in FIG. 2.
Figure 4:
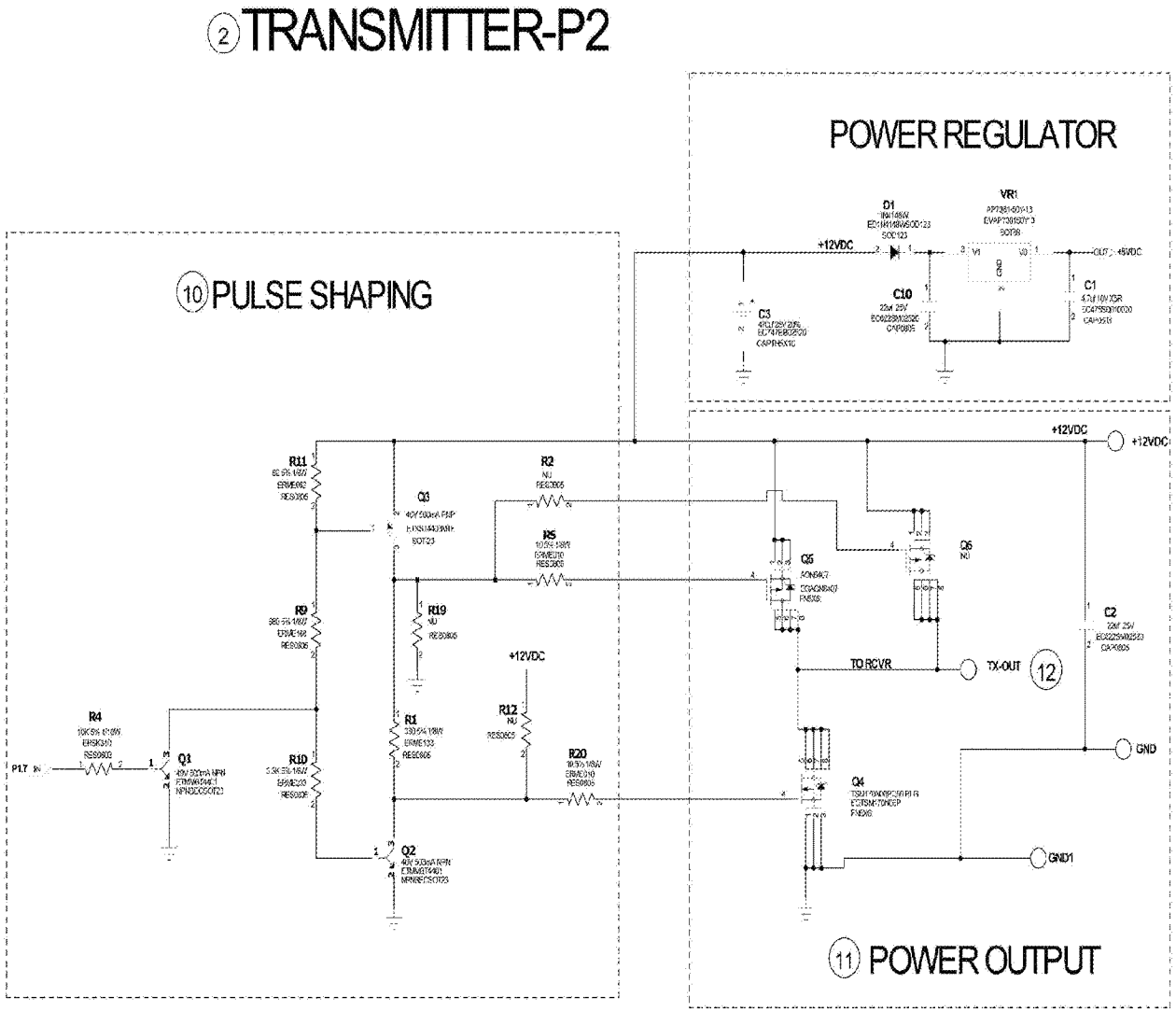

FIGS. 3 and 4 depict the transmitter side of an exemplary embodiment of the LED or other low voltage lighting control system of the present invention. In one or more embodiments, as shown in FIG. 3, the system includes an input means which may be any electromechanical user interface, such as dials, knobs, or USER PUSHBUTTONS (1), on the TRANSMITTER (2) for selecting lighting attributes, such as LED color and brightness levels. For example, every touch of pushbutton SC-1 (3) changes the color of LEDs in zone one, and every touch of pushbutton SB-1 (4) changes the brightness on the LEDs in zone one. A further advantage of the control system of the present invention is the ability to incorporate addressable devices, such that more than one zone of lighting may be controlled with a single wire, with the return wire being a neutral wire or in some cases, such as pontoon boats, the chassis of the boat. Using the chassis of the boat as a return circuit is unacceptable in any continuous PWM control of the prior art because the conductors are not parallel, and subsequently, a loop becomes a loop antenna emitting EMI and RFI. Accordingly, in the embodiment shown, pushbutton SC-2 (5) controls the color, and pushbutton SB-2 (6) controls the brightness, of LEDs in zone two. It should be understood by those skilled in the art that the use of user pushbuttons is only one such LED color and brightness input means or selection means contemplated by the present invention, and that pushbuttons are described for exemplary purposes only. These switch closures drive a table in the microcontroller which then calculates a color and brightness represented by red, blue and green numerical values, wherein proportions of said numerical values can be used to generate any color. In other embodiments, the desired lighting attributes (e.g., color, brightness) may be sent via an input data stream from a remote device, which is then processed by the lighting controller or transmitter for downstream system application.

As further shown in FIG. 3, optionally, the National Marine Electronics Association (NMEA) 183 (7) input to the NMEA RECEIVER (8) can also be used to set the red, blue and green numerical value for any lighting zone. These numerical values, along with a device address which is set by the desired lighting zone, is then serialized and encoded into a modified Manchester-type data stream which is then output by the TX MICROCONTROLLER (9). The encoding of the present invention provides several advantages, including immunity with respect to timing error, such that precision clocking is not required. In practice, it has been shown that about a 10% difference in clock speeds has been found acceptable. Other advantages include high noise immunity, an easily detected start symbol, and the elimination of accidental inversion due to a noise pulse, which could cause a data flip on remaining symbols.

It should be further understood by those skilled in the art that while the exemplary embodiment of the present invention shown in FIGS. 3-4 utilizes a type of RS-232 serial port known as an NMEA 183 as a data input, other now-known or later developed types of data inputs may also be utilized and are not intended to be precluded. Said alternate data inputs may include, but are not limited to, an NMEA 2000 CAN or CAN bus, Bluetooth®, or WiFi™.

Referring now to FIG. 4, the encoded data stream output from TX MICROCONTROLLER (9) is passed to a PULSE SHAPING (10) circuitry network, controlling the on and off drive current to the power devices or electronic switches, such as field-effect transistors (FETS) Q4, Q5, Q6, thus controlling their rise and fall times and forming rounded corner transitions, greatly reducing electromagnetic interference (EMI) and radio frequency interference (RFI) issues. The reduced EMI and RFI emissions make the LED system of the present invention particularly conducive to marine applications where digital selective calling (DSC) and automatic identification systems (AIS) are commonly used.

Figure 5:
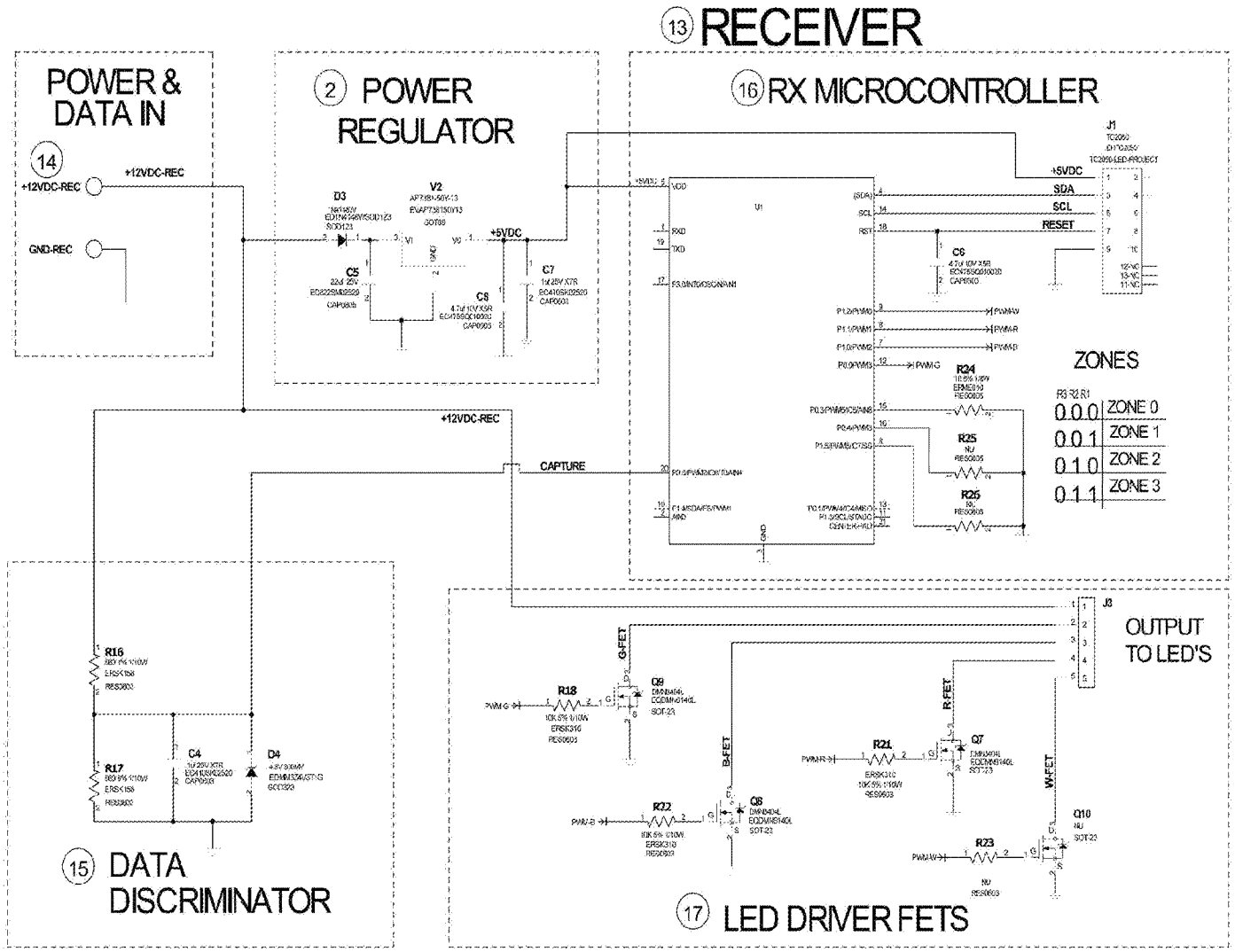
FIG. 5 is a schematic diagram depicting the receiver side of the embodiment of the LED control system shown in FIG. 2.

The encoded data stream is then propagated through the POWER OUTPUT (11) stage to the TX-OUT (12) wire. This wire (12) or output line, now carrying both power and data, is then connected to one or more RECEIVER(s) (13), as shown in FIG. 5. As data is sent, RECEIVER (13) has its +12 VDC-REC (14) line pulsed low. A DATA DISCRIMINATOR (15) then sends this stream into an RX MICROCONTROLLER (16) in one or more lighting zones. The stream is then decoded into an address and color data. The decoded device address data is compared to the device address of the receiver, each receiver having a different device address, and if the device address matches, the color values then set the pulse width modulation (PWM) registers within the RX MICROCONTROLLER (16). This PWM is then output by the RX MICROCONTROLLER (16), thus changing the duty cycle of the output power devices or LED DRIVER FETS (17) in the desired lighting zone. These FETS (17) then drive at least one set of LEDs or other low voltage lighting, with the LEDs' brightness being proportional to the PWM values.

A significant advantage of the lighting control system of the present invention is that the load is only pulsed when attributes of the lighting are changed, therefore if no change is made, there is no noise generated on the lines. Furthermore, because of the signal's low duty cycle, switching efficiency is not an issue, allowing the output to be ramped to further reduce EMI and RFI. Any PWM noise is generated only at the receiving nodes, which have lower overall current and greatly reduced lead lengths. The remaining reduced noise pulses are not synchronous and thus not adding or cumulative, rather temporarily spread, thus blending into the noise floor. As described above, another advantage of the control system of the present invention is that because the individual signal pulses are asynchronous, the system can address multiple devices, such that more than one zone of lighting can be controlled on one wire run.

An exemplary transmitter chip layout is shown in FIG. 6, and a corresponding receiver chip layout is shown in FIG. 7. As can be seen in FIGS. 6 and 7, the LED system of the present invention significantly reduces the materials and labor cost of multicolor LED systems, which typically require long multi-wire runs from the lighting controller to each LED.

Figure 8:
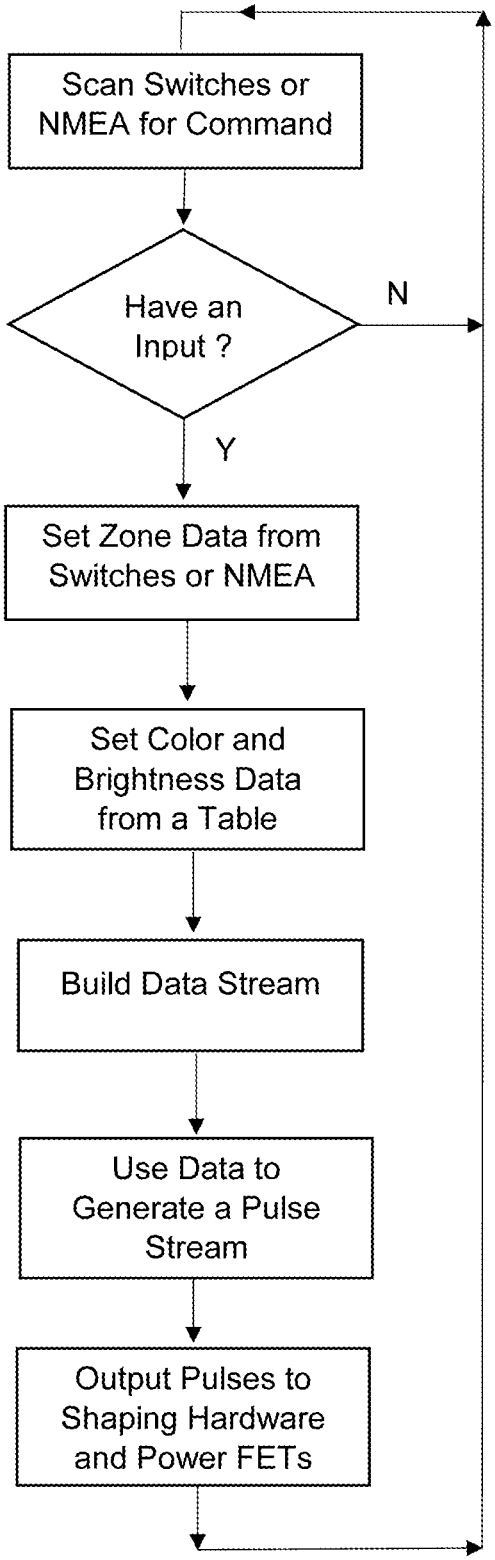
FIG. 8 is a flowchart showing representative microcontroller logic for operating modes of a transmitter for sending an encoded data stream to control the attributes of low voltage lighting, in accordance with an embodiment of the method of the present invention.
Figure 9:
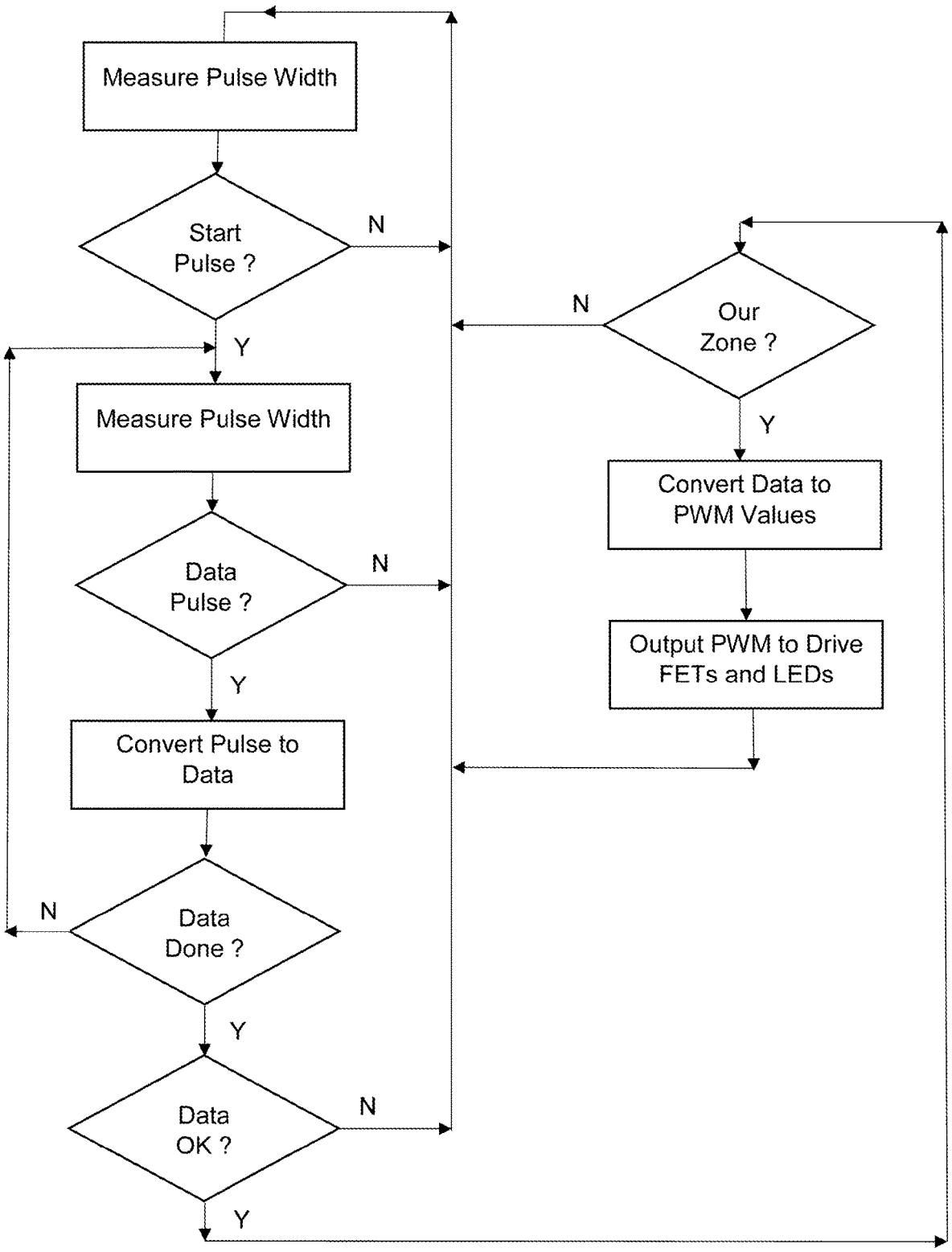
FIG. 9 is a flowchart showing representative microcontroller logic for operating modes of a receiver for receiving an encoded data stream to control the attributes of low voltage lighting, in accordance with an embodiment of the method of the present invention.

FIGS. 8 and 9 are flow charts depicting an exemplary operation of a transmitter or lighting controller and corresponding individual receiver for controlling the attributes of downstream low voltage lighting, in accordance with an embodiment of the present invention as described above. In particular, FIG. 8 shows an initial scanning mode wherein the transmitter waits for an input from the input means or an incoming data stream from a remote device, after which the inputs drive a table in the microcontroller to calculate lighting attributes based on numerical values to generate an encoded data stream. The encoded data stream is passed to pulse shaping circuitry which controls the on and off drive current to the power devices or electronic switches, such as output field-effect transistors (FETS). The data stream is then propagated through an output line carrying both power and data and is connected to one or more receivers for further processing, as depicted in FIG. 9.

As shown in FIG. 9, as data is sent, the load on the receiver is pulsed low, the width of the pulse is measured, and the pulse or data stream is then decoded or converted into device address data and data representing the selected desired lighting attributes. If the device address matches, e.g. the data is directed to the desired lighting zone, the data is converted to PWM values and output to change the duty cycle of output to power devices or FETs driving LEDs or other low voltage lighting devices in the lighting zone.

In the exemplary operations depicted in FIGS. 8 and 9, reference to PWM control of LED lighting is used for exemplary purposes only, and it should be understood by those skilled in the art that other control methods of lighting control, e.g., analog or on/off, and other low voltage lighting types, such as incandescent lighting or HID, are intended to fall within the scope of the present invention.

Thus, the present invention provides one or more of the following advantages: the present invention provides an improved control system and methods of control for low voltage lighting, wherein data and power is transmitted over a single wire run to control attributes of the lighting, such as color and brightness. The simplified low voltage lighting control system of the present invention reduces materials and labor costs, while still allowing for both white and multicolored dimmable lighting as desired, with reduced wiring complexity. The low voltage lighting system of the present invention further provides for reduced noise generated on the lines due to the load only being pulsed when attributes of the lighting are changed, and minimizes EMI and RFI emissions, making it particularly conducive to marine applications. Moreover, the present invention provides a simplified low voltage lighting control system which addresses multiple devices, such that more than one zone of lighting can be controlled on one wire run.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

The invention claimed is:

1. A low voltage wiring system for lighting control, comprising:

a transmitter comprising an input means for selecting desired lighting attributes;

a first microcontroller for outputting an encoded data stream comprising data representing lighting attributes selected via the input means, said encoded data stream propagated through pulse shaping circuitry to at least one power device;

the at least one power device driving an output wire comprising both data and power;

at least one receiver comprising a second microcontroller connected to the output wire from the transmitter for receiving both power and data from the output wire;

a data discriminator for decoding the lighting attributes from the encoded data stream;

at least one output power device; and at least one low voltage lighting device driven by the at least one output power device applying said decoded lighting attributes.

2. The system of claim 1 wherein the desired lighting attributes are selected from a group comprising at least one of color, brightness, and device address.

3. The system of claim 1 wherein the input means comprises an electromechanical user interface.

4. The system of claim 1 wherein the desired lighting attributes are sent to the transmitter via a second data stream from a remote device.

5. The system of claim 1 wherein the at least one power device and at least one output power device are field-effect transistors (FETs).

6. The system of claim 2 further including a plurality of lighting zones, each lighting zone including a receiver having a different device address and at least one low voltage lighting device, and wherein the output wire is connected to receivers in different lighting zones and the system is adapted to compare decoded device address data to a receiver device address to determine a match before applying the decoded lighting attributes to the at least one output power device for the purpose of driving the at least one low voltage lighting device in the lighting zone.

7. The system of claim 1 wherein the decoded lighting attributes are translated into a pulse width modulated output signal.

8. The system of claim 7 wherein brightness of the at least one low voltage lighting device is proportional to current of the pulse width modulated output signal.

9. The system of claim 7 wherein the decoded lighting attributes are translated into a plurality of pulse width modulated output signals, and the plurality of pulse width modulated output signals are asynchronous.

10. The system of claim 9 further including a plurality of lighting zones, wherein each lighting zone includes a receiver having a different device address, and wherein the system is adapted to asynchronously output multiple pulse width modulated signals to receivers in different lighting zones.

11. The system of claim 1 wherein the pulse shaping circuitry controls on and off current to the power devices and shapes pulse edge transitions, thus reducing electromagnetic and radio frequency interference.

12. A method for controlling lighting attributes of at least one wired low voltage lighting device, comprising:

selecting desired lighting attributes of at least one low voltage lighting device via an input means at a transmitter;

serializing and encoding the selected lighting attributes into an encoded data stream output by a first microcontroller within the transmitter;

propagating the encoded data stream through pulse shaping circuitry to at least one power device which drives an output wire comprising both data and power;

receiving both data and power from the output wire by a second microcontroller within a receiver, the second microcontroller connected to the output wire from the transmitter;

decoding the encoded data stream by a data discriminator; and applying the decoded lighting attributes to at least one output power device to drive at least one low voltage lighting device.

13. The method of claim 12 wherein the desired lighting attributes are selected from the group comprising at least one of color, brightness, and device address.

14. The method of claim 13 further including a plurality of lighting zones, each lighting zone including a receiver having a different device address, and wherein the method further comprises:

encoding at least one device address into the encoded data stream;

connecting the output wire to receivers in different lighting zones;

comparing decoded device address data to a receiver device address; and responsive to the decoded device address data and the receiver device address matching, applying the lighting attributes to at least one output power device to drive at least one low voltage lighting device in the lighting zone.

15. The method of claim 12 wherein the input means comprises an electromechanical user interface.

16. The method of claim 12 further comprising:

sending the desired lighting attributes to the transmitter via a second data stream from a remote device.

17. The method of claim 12 wherein the at least one power device and at least one output power device are field-effect transistors (FETs).

18. The method of claim 12 wherein the step of propagating the encoded data stream through pulse shaping circuitry further comprises:

controlling on and off current to the at least one power device and shaping pulse edge transitions; and reducing electromagnetic and radio frequency interference emissions.

19. The method of claim 12 further including the steps of:

translating the decoded lighting attributes into a pulse width modulated output signal; and changing a duty cycle of the at least one output power device via the pulse width modulated output signal.

20. The method of claim 19 further including a plurality of lighting zones, each lighting zone including a receiver having a different device address, and wherein the step of applying the lighting attributes to at least one output power device for the purpose of driving at least one low voltage lighting device further comprises:

asynchronously outputting multiple pulse width modulated signals to receivers in different lighting zones.

* * * * *